United States Patent [19]

Cornelius et al.

[11] 4,261,606

[45] Apr. 14, 1981

[54] EMERGENCY EASY RELEASE MECHANISM

[76] Inventors: Gary J. Cornelius, 8735 Delgany Apt. 208, Playa del Rey, Calif. 90291; James H. Moses, 1051 NW. 80 Terr. Unit D, Margate, Fla. 33063

[21] Appl. No.: 894,828

[22] Filed: Apr. 10, 1978

[51] Int. Cl.[3] ..... E05C 19/18

[52] U.S. Cl. ..... 292/258

[58] Field of Search ..... 70/423, 181; 292/258, 292/288, 307, 327

[56] References Cited

U.S. PATENT DOCUMENTS

| | | | |
|---|---|---|---|
| 1,179,190 | 4/1916 | Kelly | 292/322 |
| 2,062,417 | 12/1936 | Jay | 292/307 R X |
| 3,062,577 | 11/1962 | Wenk, Jr. | 292/307 R |
| 3,071,957 | 1/1963 | Golub | 292/288 X |
| 3,794,365 | 2/1974 | Richberg | 292/62 |

*Primary Examiner*—Richard E. Moore

[57] ABSTRACT

The invention is a device allowing easy and rapid removal of a security bar system permitting escape through a window in emergency situations when other means of escape are not available.

10 Claims, 4 Drawing Figures

EMERGENCY EASY RELEASE MECHANISM

SUMMARY OF THE INVENTION

The invention consists of a metal quick-release pin mechanism, wall rod, and rod sleeve used in conjunction with a security bar system.

The quick-release pin mechanism consists of three parts: the base plate, the cover, and the pin. The base plate is a metal plate with a hole to allow passage of a wall rod, two arch guides, four screw holes, and a snap-lock mechanism. The pin consists of a metal pin with a hinge. The cover is a plastic cover which acts as both an emergency handle and a decorative cover to hide the pin, plate, and rod. The base plate is secured to the wall by means of four screws. The cover is attached to the hinge of the pin by an epoxy.

A wall rod, which is connected on the outside of the building to a security bar system, is slid into a wall sleeve which has been permanently installed into the wall. At the end of the wall rod inside the building, and after passing through the hole in the base plate, there exists a ¼ inch hole. Therefore, the quick-release pin, which is not attached to the wall, is passed through the two arch guides and a hole in the wall rod, after which the hinge cover is snapped closed. This holds the wall rod and security bar system securely in place maintaining security yet providing an easy and rapid means of escape. In an emergency, such as fire, the cover/handle of the device is grasped with the hand and pulled to the side, drawing the pin from the wall rod, thus allowing the security bar system to be pushed away from the window.

DESCRIPTION OF THE DRAWINGS

FIG. I is a perspective view of the following: (1) the quick-release pin, (2) the pin half of the hinge, (3) the cover half of the hinge, (4) the base plate, (5) the arch guides, (6) the screws and screw holes, (7) the base plate snap-lock, (8) the wall rod, (9) the wall sleeve, (10) the cover, (11) the cover portion of the snap-lock.

In this drawing, the broken line designated III—III' represents the plane upon which the sectional view, FIG. III, is taken. Also in this drawing, the wall sleeve (9) and a portion of the wall rod (8) which is beneath the base plate, are shown. These would not normally be seen inasmuch as they would both be encased in the building wall.

Figure 1:
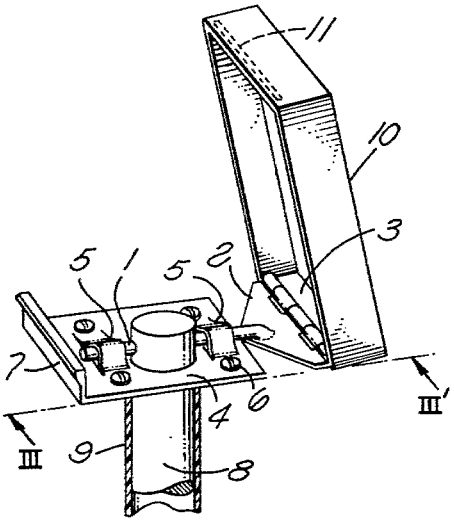
Figure 4:
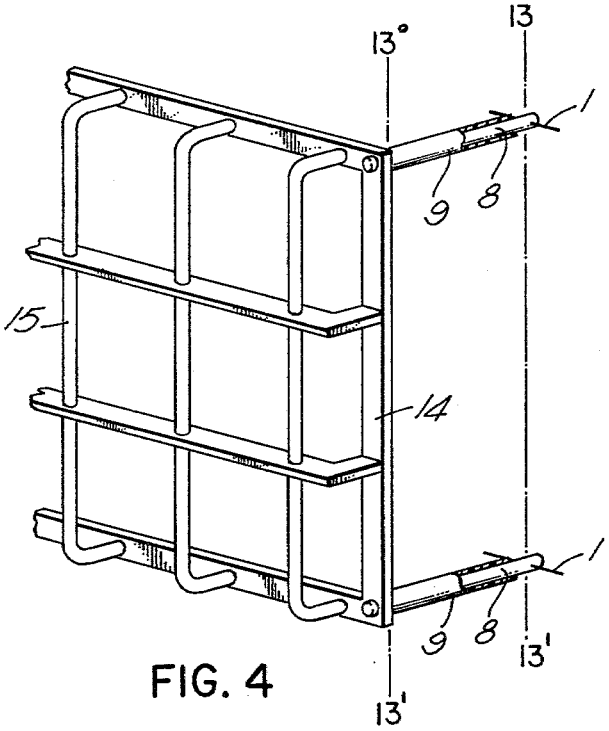
Figure 2:
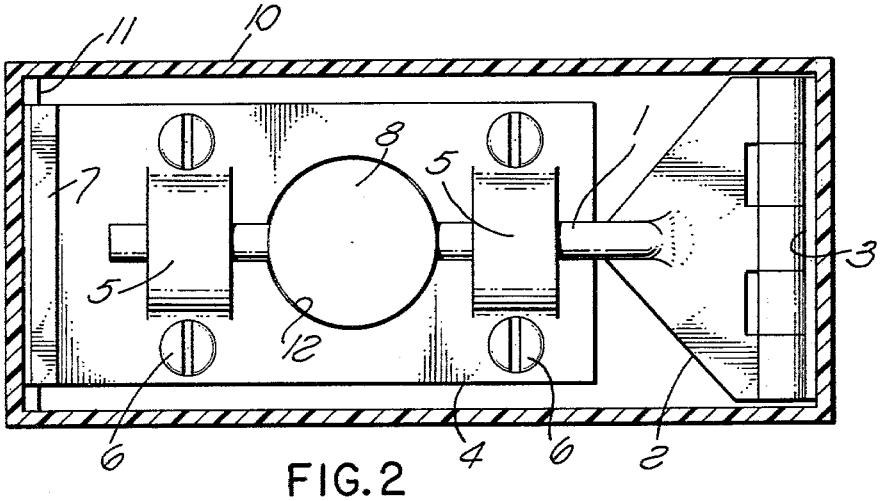
Figure 3:
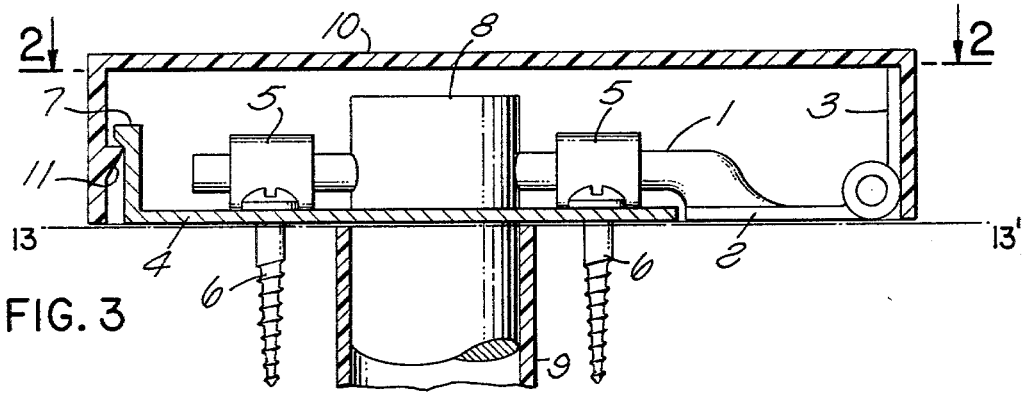

The broken line on the cover (11) is a representation of the cover portion of the snap-lock which, by forced expansion of the plastic cover over the base plate snap-lock (7) holds the cover securely over the rest of the device. This figure is drawn on a one to one scale.

FIG. II is an elevated view, or top view, of the following: numbers (1) through (8), and (10) through (12) inclusive. Number (12) is the base plate wall rod hole. The drawing is done as if the cover (10) were transparent.

FIG. III is a sectional view of FIG. I along the line designated III—III'. The end of the line marked III is at the bottom, or left, or FIG. III, and the end of the line III' is at the top, or right, of FIG. III. The drawing is done is if the cover (10) were transparent.

The broken line designated 13—13' represents the plane of the wall surface. In this drawing the threaded portion of the screws, and part of the wall rod (8) and sleeve (9) are shown. These would not normally be seen in as much as they would be encased un the wall.

FIG IV is a perspective view of one type of security bar system (15) which can be used with the, device. The security bar system or grille is drawn with an incomplete length. The drawing is only to demonstrate the arrangement of the wall rod (8) and sleeve (9) in relation to any type of security bar system having a frame (14). The end of the wall rod extends through the front of the frame. The broken line designated 13—13' represents the plane of the inner wall surface, and the broken line 13°—13' represents the plane of the outer wall surface.

DETAILED DESCRIPTION

The quick-release pin (1) is made of stainless steel alloy. It is 3/16 inch in diameter and 2 ½ inches long. Two and one-eighth inches from the free end of the pin, the pin no longer continues in a straight manner, but curves downward 1/16 inch. From the end of the curvature, where it merges into the flat portion of the pin half of the hinge (2), the total length of the pin, from that point to the free end of the pin is 2 ½ inches. The pin half of the hinge and the quick-release pin are molded as one piece.

The hinge (2 & 3) is designed and constructed as to allow movement in the normal hinge manner. The outside diameter of the interlocking portion of the hinge is 3/16 inch and this portion is 1 ½ inches in length.

The hinge is constructed in two parts as are other hinges. The first half is designated as the pin half (2) which is partly described above. As mentioned, the pin merges into the pin half of the hinge. The surface on which the pin merges is roughly triangular in shape with a 50° angle. It is 1/16 inch thick, 13/16 inch from the plane of the intersection of the pin, to the interlocking portion of the hinge. The second half of the hinge is designated as the cover half (3). It is 1/32 inch thick, 1 ½ inches wide, and ½ inch high. It is attached to the cover (10) by means of an epoxy. The cover is a rectangular box with the dimensions of 3 ½ inches long, 1 ½ inches wide, and 11/16 inch high. It is made of a phenol formaldehyde with an asbestos filler. The total thickness of the plastic is 1/16 inch. One end is connected to the hinge and pin mechanism. The other end contains the cover portion of the snap-lock (11). The cover snap-lock consists of a protrusion on the interior side of the free end. It is 1 ¼ inches long and ⅛ inch high. It is molded on the interior side at equal distance from the side edges parallel to the top of the cover. It starts at 3/16 inch from the interior bottom edge and protrudes at a 60° angle to a total height of 5/16 inch, and a thickness of 1/16 inch beyond the thickness of the rest of the cover.

The base plate (4) is made from a stainless steel alloy and consists of the following: two arch guides (5), the base plate snap-lock (7), and a hole 13/16 inch in diameter (12), and four screw holes. The plate is 1/16 inch thick, 1 ¼ inches wide, and 2 7/16 inches long. The center of the 13/16 inch diameter hole id 1 13/32 inches from the inner edge of the snap-lock, and 1 1/32 inches from the end of the plate which does not have the snap-lock. The hole is centered in regard to the width of the base plate, that is, the center of the hole is equidistant from both edges of the width.

The arch guides are two arch shaped guides 1/16 inch thick, ⅜ inch wide, and 7/16 inch long. They are located on either side of the hole parallel to the width of the base plate and to each other. They are so aligned as to allow the quick-release pin to pass under the arch portion of the guides and above the main portion of the base plate. The centers of the arch guides are 23/32 inch from the center of the hole.

The cover is held in place by a two piece snap closer, part of which is molded into the cover (11 & 10). The other part of the snap-lock is molded into the base plate (7 & 4). The snap-lock mechanism works as do other snap closers of similiar design.

The base plate portion of the snap-lock is 1 ⅜ inches wide. It is located on one edge of the base plate. The side of the wall of the snap-lock which faces out and away from the base plate (the exterior side of the wall) has an overall height of 7/16 inch. The side of the wall of the snap-lock which faces toward the base plate (interior side of the wall) has an overall height of 6/16 inch, the difference being the thickness of the base plate. The exterior side of the wall rises perpendicular to the base plate for 5/16 inch, at which point it protrudes at a 45° angle until the total height is 6/16 inch and the total thickness is ⅛ inch. It then continues perpendicular to the base plate for another 1/16 inch making the overall height 7/16 inch. On the base plate there are four screw holes (6) ⅛ inch in diameter. The holes are located adjacent to the point where the arch guides merge with the base plate; that is, there is one screw on each end of both arch guides. The distance from center to center of each pair of screw holes is ¾ inch, and are equidistant from the exterior edges of the base plate.

The wall rods (8) are made of a stainless steel alloy and are ¾ inch in diameter. The wall rod is permanently connected on one end to a security bar frame (14) of the grille 15, by welding. The wall rod is passed through the frame as to allow welding on both sides of the frame around the rod for added strength. The length of the rod is dependent on the exact thickness of the wall through which it passes. It is done in the following manner: A ¼ inch hole is drilled in the wall rod at the point at which the wall rod and the center of the quick-release pin intersect, when the pin and rod are perpendicular to each other. The wall rod is then cut ⅜ inch further past the center of the ¼ inch hole. This forms the end of the wall rod and allows the rod, base plate, and pin to be hidden by the cover. (The number of rods for each window will vary according to the size of the window.)

Permanently inserted into the holes drilled into the structure wall for the wall rod to pass through, is a tube-like wall sleeve (9). The sleeve ends must be flushed with both surfaces of the wall. The purpose of the sleeve is to provide a low friction, smooth surface through which the wall rods may slide. The inside of the sleeve is lined with Teflon R. The inside diameter of the sleeve is 13/16 inch. The sleeve is made of a 1/16 inch thick stainless steel alloy.

We claim:

1. An emergency release mechanism securing a bar of a grille through a wall comprising a base plate aperture to receive the bar, a pin positioned over said base plate, guide means on said base plate positioned to slidably receive said pin, with said pin positioned over the aperture in said base plate, for reception in a hole in the bar to releasably secure said bar to said base plate.

2. The structure of claim 1, wherein said pin has hinged thereto a cover swingable over said base plate and shaped to enclose said pin, guide means, and the end of said bar.

3. The structure of claim 2, wherein cooperating detent means are provided on the base plate and the cover, for releasably securing the cover to the base plate.

4. The structure of claim 1, wherein said detent means comprises cooperating snap detent portions.

5. The structure of claim 2, wherein said cover has secured thereto one leaf of a hinge, and said pin is secured to a second leaf of said hinge.

6. The structure of claim 1, wherein said guide means comprises at least one arched guide strap secured to said base plate.

7. The structure of claim 1, wherein a grille is secured to the other end of said bar.

8. The structure of claim 7, wherein a plurality of such rods are connected to said grille, cooperating with a like plurality of said emergency release mechanisms.

9. The structure of claim 8, wherein said rods extend through corresponding apertures in a wall and are secured therein by said mechanisms.

10. The structure of claim 9, wherein a sleeve is fitted in each aperture, surrounding a corresponding rod.

* * * * *